United States Patent [19]

Castro et al.

[11] Patent Number: 4,798,679

[45] Date of Patent: Jan. 17, 1989

[54] CONTROLLED SUDSING STABLE ISOTROPIC LIQUID DETERGENT COMPOSITIONS

[75] Inventors: Artemio Castro, Fairfield; Michael S. Showell, Cincinnati, both of Ohio

[73] Assignee: The Procter & Gamble Co., Cincinnati, Ohio

[21] Appl. No.: 48,155

[22] Filed: May 11, 1987

[51] Int. Cl.[4] ..... C11D 3/12; C11D 9/36; C11D 17/08

[52] U.S. Cl. ..... 252/174.15; 252/173; 252/321; 252/550; 252/558; 252/DIG. 14

[58] Field of Search ..... 252/321, 558, 174.15, 252/174.21, 173, DIG. 14

[56] References Cited

U.S. PATENT DOCUMENTS

| | | | |
|---|---|---|---|
| 3,455,839 | 7/1969 | Raumer | 252/321 |
| 3,933,672 | 1/1976 | Bartolotta | 252/116 |
| 4,284,532 | 8/1981 | Leikhim | 252/528 |
| 4,285,841 | 8/1981 | Barrat et al. | 252/559 |
| 4,287,082 | 9/1981 | Tolfo et al. | 252/174.12 |
| 4,405,490 | 9/1983 | Maas | 252/358 |
| 4,436,653 | 3/1984 | Jacobson | 252/547 |
| 4,477,371 | 10/1984 | Huber et al. | 252/358 |
| 4,507,219 | 3/1985 | Hughes | 252/118 |
| 4,652,392 | 3/1987 | Baginski et al. | 252/109 |

*Primary Examiner*—Paul Lieberman
*Assistant Examiner*—Kathleen Markowski
*Attorney, Agent, or Firm*—Donald E. Hasse; Richard C. Witte; Thomas H. O'Flaherty

[57] ABSTRACT

Stable isotropic liquid detergent compositions containing a particular silicone suds controlling agent, a sudsing detergent surfactant and water. Such compositions can be prepared if a suitable dispersing agent is premixed with the suds controlling agent prior to incorporation in the liquid detergent composition.

13 Claims, No Drawings

CONTROLLED SUDSING STABLE ISOTROPIC LIQUID DETERGENT COMPOSITIONS

TECHNICAL FIELD AND BACKGROUND ART

The present invention relates to the formulation of a stable isotropic liquid detergent composition containing a particular silicone suds controlling agent that is capable of suppressing or controlling the suds profile of the liquid detergent composition, even after months of storage.

Silicones are widely known and taught for use as highly effective suds controlling agents. For example, U.S. Pat. No. 3,455,839 relates to compositions and processes for defoaming aqueous solutions by incorporating therein small amounts of polydimethylsiloxane fluids.

Useful suds controlling silicones are mixtures of silicone and silanated silica as described, for instance, in German Patent Application No. DOS 2,124,526.

Silicone defoamers and suds controlling agents have been successfully incorporated into granular detergent compositions by protecting them from detergent surfactants as in U.S. Pat. No. 3,933,672, Bartolotta et al, and in U.S. Pat. No. 4,652,392, Baginski et al, issued Mar. 24, 1987. However, such suds controlling agents have not been used in stable isotropic liquid detergent compositions because of either surfactant incompatibility or difficulty in obtaining single phase isotropic liquids. Surprisingly, it has now been found that it is possible to make premixes of dispersing agents and certain suds controlling agents that can be used to prepare stable isotropic liquid detergent compositions.

SUMMARY OF THE INVENTION

The invention encompasses suds controlling agent compositions comprising:

(a) suds controlling agent consisting essentially of:
  (i) polydimethylsiloxane fluid having a viscosity of from about 20 cs to about 1500 cs at 25° C.; and
  (ii) from about 5 to about 70 parts per 100 parts of (i) of non-crystalline $SiO_2$, preferably selected from the group consisting of siloxane resin, especially one composed of $(CH_3)_3\ SiO_{\frac{1}{2}}$ units and $SiO_2$ units in a ratio of $(CH_3)_3\ SiO_{\frac{1}{2}}$ units to $SiO_2$ units of from about 0.6:1 to about 1.2:1; solid silica gel; and mixtures thereof; and (b) dispersing agent selected from the group consisting of nonionic surfactants having HLBs of greater than about 13.5; solvent for said polydimethylsiloxane; and mixtures thereof at a level of from about 50% to about 99.8% by weight of the composition.

Such compositions can be used to form stable isotropic liquid detergent compositions having a controlled suds pattern by addition to at least a portion of the remainder of the detergent composition in a simple mixing step. Accordingly, the present invention also encompasses stable isotropic liquid detergent compositions having a controlled suds pattern, comprising:

(a) a suds suppressing amount of a suds controlling agent consisting essentially of:
  (i) polydimethylsiloxane fluid having a viscosity of from about 20 cs. to about 1500 cs. at 25° C.;
  (ii) from about 5 to about 50 parts per 100 parts by weight of (i) of siloxane resin composed of $(CH_3)_3\ SiO_{\frac{1}{2}}$ units and $SiO_2$ units in a ratio of $(CH_3)_3\ SiO_{\frac{1}{2}}$ units to $SiO_2$ units of from about 0.6:1 to about 1.2:1; and
  (iii) from about 1 to about 20 parts per 100 parts by weight of (i) of a solid silica gel;

(b) from about 1% to about 60% by weight of sudsing detergent surfactant selected from the group consisting of anionic, nonionic, zwitterionic, ampholytic, and cationic surfactants, and mixtures thereof; and (c) from 0% to about 95% by weight of water.

The silicone suds controlling agent of the present compositions is employed in a "suds suppressing amount". By "suds suppressing amount" is meant that the formulator of the compositions can select an amount of this suds controlling agent that will control the suds to the extent desired. The amount of suds control will vary with the detergent surfactant selected. For example, with high sudsing surfactants, relatively more of the suds controlling agent is used to achieve the desired suds control than with low foaming surfactants.

DETAILED DESCRIPTION OF THE INVENTION

The suds controlling agent compositions of the present invention comprise a suds controlling agent which is primarily polydimethylsiloxane fluid having a viscosity at 25° C. of from about 20 cs to about 1500 cs, non-crystalline solid silica ($SiO_2$) which can either be a siloxane resin or solid amorphous silica like a xerogel or more preferably an aerogel or even more preferably, mixtures thereof. Such suds controlling agents, to be effective, must be in finely dispersed form, having a fairly narrow size range as set forth hereinafter. It is extremely difficult to create and maintain that finely dispersed form, especially in a liquid detergent composition, and especially in the presence of relatively high ionic strengths.

It has been found that one way of forming the stable dispersion, suspension, or emulsion is to premix the suds controlling agent with a dispersing agent that at least breaks up the bulk suds controlling agent into a form that is at least closer to finely divided form. Solvents for the polydimethylsiloxane fluid like cyclomethicone can accomplish this break-up as can nonionic surfactants having an HLB above about 13.5, preferably above about 14. The most preferred embodiment then preforms the dispersion/emulsion/suspension (DES). The high HLB nonionic surfactant can accomplish both steps and will be stable in the presence of high ionic strengths in the finished liquid detergent composition. The term "high ionic strengths" includes ionic strengths of about 0.9 or greater, preferably about 0.95 or greater, or more preferably about 1.0 moles per 100 gms of product or greater. If the solvent is used, it is highly desirable that the suds controlling agent composition be mixed with a surfactant having a high HLB before it is mixed with the remainder of the detergent composition, especially if it has a high ionic strength. It is also desirable to allow sufficient time for the emulsion to form. When the solvent is used, any high HLB anionic, nonionic, and/or amphoteric surfactant can then form the stable DES when the suds controlled agent composition is mixed with the remainder of the composition, or at least a portion thereof, containing the surfactant and water.

The detergent compositions of the present invention are stable, preferably isotropic, liquid detergents comprising said silicone suds controlling agent, detergent surfactant, and water.

The detergent compositions herein are preferably stable isotropic liquids as made, for example at about 70° F. (21.1° C.), and preferably remain as stable isotropic liquids during shipping and storage where temperature of 55° F. (12.8° C.) or lower are encountered.

Suds Controlling Agent

A preferred suds controlling agent herein comprises a mixture of a silicone fluid, a silicone resin and silica, and is described in U.S. Pat. No. 4,652,392, Baginski et al, issued Mar. 24, 1987, incorporated herein by reference, particularly from Column 4, line 46 through Column 5, line 12. the other suds controlling agents described in this patent that contain the appropriate levels of polydimethylsiloxane and non-crystalline silica can also be used.

This preferred silicone fluid/silicone resin/silica mixture can be prepared in the manner disclosed in U.S. Pat. No. 3,455,839, incorporated herein by reference. These materials are commercially available from the Dow Corning Corporation and can be described as mixtures consisting essentially of:

for each 100 parts by weight of a polydimethylsiloxane fluid having a viscosity in the range from 20 cs. to 1500 cs. at 25° C., (a) from about 5 to about 50, preferably from about 5 to about 20, parts by weight of a siloxane resin composed of $(CH_3)_3SiO_{\frac{1}{2}}$ units and $SiO_2$ units in which the ratio of the $(CH_3)_3SiO_{\frac{1}{2}}$ units to the $SiO_2$ units is within the range of from abut 0.6:1 to about 1.2:1; and (b) from about 1 to about 20, preferably from about 1 to about 15, parts by weight of a solid silica gel, such as a xerogel or, preferably, an aerogel.

The particle size of the silica employed in such suds controlling agents should be not more than about 1000, preferably not more than about 100 millimicrons, preferably from about 5 millmicrons to about 50 millimicrons, more preferably from about 10 to about 20 millicrons, and the specific surface area of the silica should exceed about 5 $m^2/g$, perferably more than about 50 $m^2/g$.

In addition, the silicon "droplets" in the DES are preferably from about 1 to about 50 microns, more preferably from about 5 to about 40 microns, and even more preferably from about 5 to abot 30 microns in diameter for maximum effectiveness. Droplets below about 5 microns in diameter are not very effective and above about 30 microns in diameter are increasingly less effective. Similar sizes are suitable for the other silicone suds controlling agents disclosed hereinafter.

The dispersing agent disperses or helps disperse the silicone suds control agent uniformly so that stable, preferably isotropic, detergent formulas can be prepared. The dispersing agent is premixed with the suds controlling agent prior to incorporation into the liquid detergent composition.

Suitable dispersing agents include materials such as ethylene oxide adducts of linear or arylphenols having from 8 to 20 carbon atoms per molecule, such as lauryl polyoxethylene glycol ether, stearyl polyoxyethylene glycol ether, cetyl polyoxyethylene glycol ether, and nonylphenol polyoxyethylene glycol ether, and also ethylene oxide adducts of linear or branched monocarboxylic acids and having HLBs of greater than about 13.5, preferably greater than about 14. Preferably, such addition products have short hydrophobic chains containing 12 or preferably less carbon atoms and from about 8 to about 15 ethylene oxide units per molecule. Other examples of preferred dispersants are polyoxyethylene glycol sorbitan esters of polyoxyethylene glycol sorbital esters having HLB values of 14 or more, such as polyoxyethylene glycol sorbitan hexaoleate or polyoxyethylene sorbitol hexaoleate. (These materials are disclosed in U.S. Pat. No. 4,076,648 to Rosen, incorporated herein by reference). Additional examples of preferred dispersants are fatty acid mono-, di-, and/or polyglycerides and sodium or calcium stearoyl lactate, diglycerol stearate, and sorbitan monostearate.

The suds controlling agent compositions of the present invention can contain a single type of dispersant or mixtures of at least two different types of dispersants.

Other useful dispersants are commercial oxyethylated polyhydric alcohols or their derivatives or similar compounds having an active hydrogen atom, as well as fatty acid esters of glycerol or sorbitol. The amount of ethylene oxide which has formed an adduct with the abovementioned products can vary; it determines the hydrophilic character and hence the magnitude of the HLB value.

Anionic emulsifiers, such as sodium dodecylbenzenesulphonate or sodium laurylsulphate, can also be used, but preferably with a solvent.

Preferred is an emulsifier mixture of oxyethylated fatty alcohol and oxyethylated triglyceride having an HLB value preferably in the range from about 14 to 16.

The preferred solvent for dimethylpolysiloxane is pentameric cyclomethicone. Particularly preferred dispersants for use herein are cyclomethicone and $C_9$–$C_{11}$ linear chain alcohols ethoxylated with from about 7 to about 10 moles of ethylene oxide per mole of alcohol especially when the unreacted alcohol and monoethoxylated alcohol are removed and mixtures thereof.

The weight ratio of dispersant to silicone suds controlling agent can be from about 1:1 to about 500:1, but preferably is from about 3:1 to about 150:1. The amount of dispersant in the suds controlling agent compositions is from about 50% to about 99.8%, preferably from about 75% to about 99.6%.

Detergent compositions comprising the suds control agent and the detergent surfactant can be provided having various ratios and proportions of these two materials. Of course, the amount of the suds control agent can be varied, depending upon the suds profile desired by the formulator. Moreover, the amount of detergent surfactant can be varied to provide either heavy-duty or light-duty products, as desired.

For most purposes, it is preferred to use a sufficient amount of the silicone suds controlling agent in the detergent composition to provide a concentration of from about 0.0005% to about 1% by weight of the silicone suds controlling agent in the composition. A preferred amount of silicone suds controlling agent in the detergent composition lies within the range of from about 0.01% to about 0.5%, more preferably from about 0.02% to about 0.1% by weight.

Detergent Surfactant

The amount of detergent surfactant can, as noted above, vary over a wide range which depends on the desires of the user. In general, the compositions contain from about 1% to about 60%, preferably from about 5% to about 50%, more preferably from about 10% to about 30%, by weight of detergent surfactant.

The detergent compositions of the instant invention can contain all manner of organic, water-soluble detergent surfactants. A typical listing of the classes and species of detergent surfactants useful herein appear in U.S. Pat. No. 3,664,961, incorporated herein by reference. The following list of detergent surfactants and mixtures which can be used in the instant compositions is representative of such materials, but is not intended to be limiting.

Water-soluble salts of the higher fatty acids, i.e., "soaps", are useful as the detergent surfactant of the composition herein. This class of detergents includes ordinary alkali metal soaps such as the sodium potassium, ammonium and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergent surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkylbenzene sulfonates, in which the alkyl group contains from about 9 to about 15 carbon atoms, in straight chain or branched chain configuration, e.g. those of the type described in U.S. Pat. Nos. 2,220,099 and 2,477,383, incorporated herein by reference. Especially valuable are linear straight chain alkylbenzene sulfonates in which the average of the alkyl groups is about 12 carbon atoms, abbreviated as $C_{12}$ LAS.

Other anionic detergent surfactants herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing from about 1 to about 10 units of ethylene oxide per molecule and wherein the alkyl groups contain about 8 to about 13 carbon atoms.

Water-soluble nonionic synthetic detergent surfactants are also useful in the instant composition. Such nonionic detergent surfactants can be broadly defined as compounds produced by the condensation of ethylene oxide grous (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

For example, a well-known class of nonionic synthetic detergent surfactants is made available on the market under the trade name of "Pluronic". These compounds are formed by condensing ethylene oxide with a hydrophobic base formed by the condensation of propylene oxide with propylene glycol. Other suitable nonionic synthetic surfactants include the polyethylene oxide condensates of alkyl phenols, e.g., the condensation products of alkyl phenols having an alkyl group containing from about 6 to about 13 carbon atoms in either a straight chain or branched chain configuration, with ethylene oxide, the said ethylene oxide being present in amounts equal to from about 4 to about 15 moles of ethylene oxide per mole of alkyl phenol.

The water-soluble condensation products of aliphatic alcohols having from about 8 to about 22 carbon atoms, in either straight chain or branched configuration, with ethylene oxide, e.g., a coconut alcohol-ethylene oxide condensate having from about 5 to about 30 moles of ethylene oxide per mole of coconut alcohol, the coconut alcohol fraction having from about 10 to about 14 carbon atoms, are also useful nonionic surfactants herein.

Semi-polar nonionic detergent surfactants include water-soluble amine oxides containing one alkyl moiety of from about 10 to about 20 carbon atoms and 12 moieties selected from the group consisting of alkyl groups and hydroxyalkyl groups containing from 1 to about 3 carbon atoms; water-soluble phosphine oxides containing one alkyl moiety of from about 10 to 20 carbon atoms and 2 moieties selected from the group consisting of alkyl grous and hydroxyalkyl groups containing from 1 to about 3 carbon atoms; and water-soluble sulfoxides containing one alkyl or hydroxyalkyl moiety of from about 10 to about 20 carbon atoms and a moiety selected from the group consisting of alkyl and hydroxyalkyl moieties of from 1 to about 3 carbon atoms.

Ampholytic detergent surfactants include derivatives of aliphatic or aliphatic derivatives of heterocyclic secondary and tertiary amines in which the aliphatic moiety can be straight chain or branched and wherein one of the aliphatic substituents contains from about 8 to about 18 carbon atoms and at least one aliphatic substituent contains an anionic water-solubilizing group.

Zwitterionic detergent surfactants include derivatives of aliphatic quaternary ammonium, phosphonium and sulfonium compounds in which the aliphatic moieties can be straight chain or branched, and wherein one of the aliphatic substituents contains from about 8 to about 18 carbon atoms and one contains an anionic water-solubilizng group. The quaternary compounds, themselves, e.g. cetyltrimethyl ammonium bromide, can also be used herein.

Other useful detergent surfactants herein include the water-soluble salts of esters of alpha-sulfonated fatty acids containing from about 6 to about 20 carbon atoms in the fatty acid group and from 1 to about 10 carbon atoms in the ester group; water-soluble salts of 2-acyloxy-alkane-1-sulfonic acids containing from about 2 to about 9 carbon atoms in the acyl group and from about 9 to about 20 carbon atoms in the alkane moiety; alkyl ether sulfates containing from about 10 to about 20 carbon atoms in the alkyl group and from about 1 to about 12 moles of ethylene oxide; water-soluble salts of olefin sulfonates containing from about 12 to about 20 carbon atoms; and beta-alkyloxy alkane sulfonates containing from about 1 to 3 carbon atoms in the alkyl group and from about 8 to 20 carbon atoms in the alkane moiety.

Preferred water-soluble organic detergent surfactants herein include linear alkylbenzene sulfonates containing from about 11 to about 13 carbon atoms in the alkyl group; $C_{10-18}$ alkyl sulfates; the $C_{10-16}$ alkyl glyceryl sulfonates; $C_{10-18}$ alkyl ether sulfates, especially wherein the alkyl moiety contains from about 14 to 18 carbon atoms and wherein the average degree of ethoxylation between 1 and 6; $C_{10-18}$ alkyl dimethyl amine oxides, especially wherein the alkyl group contains from about 11 to 16 carbon atoms; alkyldimethyl ammonio propane sulfonates andd alkyldimethyl ammonio hydroxy propane sulfonates wherein the alkyl group in both types contains from 14 to 18 carbon atoms; soaps, as hereinabove defined; and the condensation product of $C_{10-18}$ fatty alcohols with from about 3 to about 15 moles of ethylene oxides.

Specific preferred detergent surfactants for use herein include: sodium linear $C_{10-13}$ alkylbenzene sulfonates; sodium $C_{12-18}$ alkyl sulfates; sodium salts of sulfated condensation product of $C_{12-18}$ alcohols with from about 1 to about 3 moles of ethylene oxide; the condensation product of $C_{10-18}$ fatty alcohols with from about 4 to about 10 moles of ethylene oxide; and the water-soluble sodium and potassium salts of higher fatty acids containing from about 10 to about 18 carbon atoms.

Any of the foregoing can be used separately herein, or as mixtures.

An especially preferred alkyl ether sulfate detergent surfactant of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 1 to 3 moles of ethylene oxide.

Water

The compositions of the present invention also contain from 0% to about 95%, preferably from about 15% to about 70%, by weight of water, more preferably from about 20% to about 40%.

Optional Additives

The detergent compositions of the present invention can also contain water-soluble builders such as those commonly taught for use in detergent compositions. Such auxilliary builders can be employed to sequester hardness ions and to help adjust the pH of the laundering liquor. Such builders can be employed in concentrations of from about 1% to about 30% by weight, preferably from about 5% to about 20% by weight, of the detergent compositions herein to provide their builder and pH-controlling functions. The builders herein include any of the conventional inorganic and organic water-soluble salts.

Such builders can be, for example, water-soluble salts of phosphates including tripolyphosphates, pyrophosphates, orthophosphates, higher polyphosphates, carbonates, silicates, and organic polycarboxylates. Specific preferred examples of inorganic phosphate builders include sodium and potassium tripolyphosphates and pyrophosphates.

Specific examples of nonphosphorus, inorganic detergent builder ingredients include water-soluble inorganic carbonate, bicarbonate, and silica salts. The alkali metal, e.g., sodium and potassium, carbonates, bicarbonates, and silicates are particularly useful herein.

Water-soluble, organic builders are also useful herein. For example, the alkali metal, ammonium and substituted ammonium polycarboxylates are useful in the present compositions. Specific examples of the polycarboxylate builder salts include sodium, potassium, ammonium and substituted ammonium salts of ethylenediaminetetraacetic acid, nitrilotriacetic acid, oxydisuccinic acid, mellitic acid, benzene polycarboxylic acid, polyacrylic acid, polymaleic acid, and citric acid.

Other desirable polycarboxylate builders are the builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Cruthfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

A particularly preferred builder for use herein is the tartrate succinate builder described in U.S. Pat. No. 4,663,071, Bush et al, issued May 5, 1987, incorporated herein by reference.

The detergent conditions herein can contain all manner of additional materials commonly found in laundering and cleaning compositions. For example, the compositions can contain thickeners and soil-suspending agents such a carboxymethylcellulose and the like. Enzymes, especially the proteases, amylases and lipases, can also be present herein. Various perfumes, optical bleaches, fillers, fabric softeners and the like can be present in the compositions to provide the usual benefits occasioned by the use of such materials in detergent compositions.

A finished detergent composition of this invention can contain minor amounts of materials which make the product more attractive. The following are mentioned by way of example: a tarnish inhibitor such as benzotriazole or ethylene thiourea can be added in amounts up to 2% by weight; fluorescers, perfumes and dyes, while not essential, can be added in small amounts. An alkaline material such as sodium or potassium carbonate or hydroxide can be added in minor amounts as supplementary pH adjusters. There can also be mentioned, as suitable additives: bacteriostats, bactericides, and corrosion inhibitors such as soluble alkali silicates (preferably sodium silicates having an $SiO_2/Na_2O$ ratio of from 1:1 to 2.8:1), All percentages, parts and ratios herein are by weight unless otherwise specified.

The following examples illustrate the compositions herein.

EXAMPLE I

The following composition of the present invention is prepared by adding the components to a mixing tank in the order listed with continuous mixing.

| Components | % Assay[1] | Actual Wt. Added (lb) | Wt. % in Product |
|---|---|---|---|
| 1,2-Propanediol | 100.00 | 230.0 | 11.29 |

-continued

| Components | % Assay[1] | Actual Wt. Added (lb) | Wt. % in Product |
|---|---|---|---|
| $C_{12-13}$ alcohol polyethoxylate (6.5)* | 100.00 | 28.5 | 2.96[3] |
| $C_{14-15}$ alkyl polyethoxylate (2.25) sulfonic acid | 48.71[2] | 455.8 | 10.90 |
| $C_{13}$ linear alkylbenzene sulfonic acid | 96.00 | 158.3 | 7.46 |
| Brightener | 2.16[4] | 105.6 | 0.11 |
| Citric Acid[5] | 50.00 | 152.0 | 3.73 |
| Tartrate succinate**[5] | 40.00 | 190.0 | 3.73 |
| Monoethanolamine | 100.00 | 38.0 | 2.25[3] |
| $C_{12}$ alkyl succinic acid | 95.00 | 140.0 | 6.53 |
| Sodium hydroxide | 50.00 | 115.2 | 3.98[3] |
| Potassium hydroxide | 45.00 | 67.1 | 1.48 |
| $C_{8-18}$ fatty acid*** | 100.00 | 57.0 | 2.80 |
| Ethanol | 92.0 | 82.6 | 7.36 |
| Sodium formate | 30.00 | 50.7 | 0.75 |
| Calcium formate | 10.00 | 9.5 | 0.05 |
| Sodium diethylenetriamine pentaacetate | 41.00 | 13.9 | 0.28 |
| $C_{12}$ alkyltrimethylammonium chloride | 37.00 | 30.8 | 0.56 |
| TEPA-$E_{15-18}$**** | 80.00 | 35.6 | 1.40 |
| Protease enzyme (2.0 AU/g) | — | 17.7 | 0.014 AU/g |
| Amylase enzyme (375 AM. U/g) | — | 3.0 | 520 AMU/g |
| Dyes | 1.00[6] | 8.0 | <0.01 |
| Perfume | 100.00 | 5.7 | 0.28 |
| Boric acid | 100.00 | 19.0 | 0.93 |
| 1,2-Propanediol | 100.00 | 19.0 | 0.93 |
| Suds suppressor[7] | 100.00 | 3.8 | 0.20 |

[1]Balance to 100% is water unless otherwise noted.
[2]Balance also includes 5.17% sodium hydroxide and 16.20% ethanol.
[3]From more than one source.
[4]Balance also includes 7.48% monoethanolamine and 30.1% $C_{12-13}$ alcohol polyethoxylate (6.5)*.
[5]Added as a premix of tartrate succinate and citric acid.
[6]Balance also includes 1.50% monoethanolamine.
[7]Premix of cyclomethicone and a silicone suds suppressor (a commercially availably silicone/silica fluid containing about 75% polydimethyl siloxane having a viscosity of 20 cs-1,500 cs at 25.0° C.; about 15% siloxane resin; and about 10% silica aerogel having an average ultimate particle size of about 12 millimicrons agglomerated to an average of 1.3-1.7 microns and having a surface area of ~325 $m^2/g$) in a weight ratio of 3:1, respectively.
*Alcohol and monoethoxylated alcohol removed.
**Prepared as in Reaction Sequence I of U.S. Pat. No. 4,663,071, Bush et al, issued May 5, 1987.
***Mixture consists of about 68% $C_{12}/C_{14}$ saturated fatty acid, 18% oleic acid, 8% $C_{16}$ fatty acid, and 3% each of $C_8$ and $C_{10}$ fatty acids.
****Tetraethylene pentaimine ethoxylated with 15-18 moles (avg.) of ethylene oxide at each hydrogen site on each nitrogen.

The above composition is a stable isotropic liquid as made at about 70° F., has a molar ratio of sodium to potassium of about 6.2:1, contains about 28% water, has an ionic strength of 1.1 moles per 100 gms of product, and has an initial pH of about 8.35 when measured at a concentration of 10% by weight in water at 20° C.

The boric acid is mixed into the above composition after a phase split has occurred and causes the composition to return to a stable isotropic form. If this order of addition is not followed, a stable composition can be obtained by premixing the boric acid with citric acid and 1,2-propanediol.

EXAMPLE II

The following stable isotropic liquid detergent composition of the present invention is prepared by making the indicated premixes and then adding the components to a mixing tank in the order listed with continuous mixing.

| Components | % Assay[1] | Wt. % in Product | Actual Wt. Added (gms) |
|---|---|---|---|
| PREMIX ONE | | | |
| Water | 100.00 | 7.57 | 76.44 |

-continued

| Components | % Assay[1] | Wt. % in Product | Actual Wt. Added (gms) |
|---|---|---|---|
| Polyethylene glycol 8000 | 100.00 | 0.91 | 9.10 |
| Calcium hydroxide | 97.00 | 0.08 | 0.82 |
| Citric acid | 100.00 | 1.87 | 18.70 |
| Sodium formate | 100.00 | 0.91 | 9.10 |
| Boric acid | 100.00 | 0.94 | 9.40 |
| | | TOTAL: | 123.56 |
| PREMIX TWO | | | |
| 1,2-Propanediol | 100.00 | 5.00 | 50.00 |
| Brightener | 100.00 | 0.11 | 1.10 |
| Brightener | 100.00 | 0.06 | 0.60 |
| | | TOTAL: | 51.70 |
| PREMIX THREE | | | |
| $C_{9-11}$ alcohol polyethoxylate (8)* | 100.00 | 5.45 | 54.50 |
| Suds suppressor[2] | 100.00 | 0.03 | 0.30 |
| | | TOTAL: | 54.80 |
| MAIN FORMULA | | | |
| Tartrate succinate** | 40.40 | 4.95 | 122.52 |
| PREMIX ONE | 100.00 | 4.99 | 123.56 |
| 1,2-Propanediol (added separately in addition to PREMIX TWO) | 100.00 | 11.31 | 113.10 |
| Sodium cumene sulfonate | 45.00 | 5.61 | 124.67 |
| Monoethanolamine | 100.00 | 1.87 | 18.70 |
| Sodium hydroxide | 48.80 | 3.10 | 63.52 |
| $C_{11.8}$ linear alkylbenzene sulfonic acid | 96.48 | 23.17 | 240.15 |
| $C_{12-14}$ Fatty acid | 100.00 | 2.80 | 28.00 |
| Sodium diethylenetriamine pentaacetate | 43.00 | 0.27 | 6.28 |
| PREMIX TWO | 100.00 | 5.17 | 51.70 |
| PREMIX THREE | 100.00 | 5.48 | 54.80 |
| TEPA-$E_{15-18}$*** | 80.00 | 1.87 | 23.38 |
| pH TRIM | 100.00 | 2.00 | 20.00 |
| Protease enzyme | 127.90 | 0.91 | 7.11 |
| Amylase enzyme | 100.00 | 0.16 | 1.80 |
| Perfume | 100.00 | 0.09 | 0.90 |

[1]Balance to 100% is water unless otherwise noted.
[2]A commercially available (a commercially availably silicone/silica fluid containing about 75% polydimethyl siloxane having a viscosity of 20 cs-1,500 cs at 25.0° C.; about 15% siloxane resin; and about 10% silica aerogel having an average ultimate particle size of about 12 millimicrons agglomerated to an average of 1.3-1.7 microns and having a surface area of ~325 $m^2/g$)
*Alcohol and monoethoxylated alcohol removed.
**Prepared as in Reaction Sequence I of U.S. Pat. No. 4,663,071, Bush et al, issued May 5, 1987.
***Tetraethylene pentaimine ethoxylated with 15-18 moles (avg.) of ethylene oxide at each hydrogen site on each nitrogen.

This composition had an ionic strength of about 0.95 moles per 100 gms of product.

What is claimed is:

1. A suds controlling agent composition consisting essentially of:

(a) suds controlling agent consisting essentially of:
  (i) polydimethylsiloxane fluid having a viscosity at 25° C. of from about 20 cs to about 1500 cs and
  (ii) from about 5 to about 70 parts per 100 parts of (i) of non-crystalline silica and
(b) from about 50% to about 99.8% by weight of the composition of cyclomethicone dispersing agent.

2. The composition of claim 1 wherein said non-crystalline silica is selected from the group consisting of (a) siloxane resin composed of first $(CH_3)_3SiO_{\frac{1}{2}}$ units and second $SiO_2$ units in the ratio of first to second units of from about 0.6:1 to about 1.2:1.

3. A stable isotropic liquid detergent composition having a controlled suds pattern, comprising:

(a) a suds suppressing amount of a suds controlling agent consisting essentially of:
  (i) polydimethylsiloxane fluid having a viscosity of from about 20 cs. to about 1500 cs. at 25° C.;

(ii) from about 5 to about 70 parts per 100 parts by weight of (i) of non-crystalline silica selected from the group consisting of siloxane resin composed of $(CH_3)_3SiO_{\frac{1}{2}}$ units and $SiO_2$ units in a ratio of $(CH_3)_3SiO_{\frac{1}{2}}$ units to $SiO_2$ units of from about 0.6:1 to about 1.2:1; solid silica gel; and mixtures thereof;

(b) from about 1% to about 60% by weight of a sudsing detergent surfactant selected from the group consisting of anionic, nonionic, zwitterionic, ampholytic, and cationic surfactants and mixtures thereof; and (c) from 0% to about 95% by weight of water, and (d) cyclomethicone dispersing agent which is premixed with the suds controlling agent prior to adding the suds controlling agent to the detergent composition.

4. The composition of claim 3 wherein the silicone suds controlling agent has an average droplet diameter of from about 1 to about 50 microns.

5. The composition of claim 4 wherein the average droplet diameter is from about 5 to about 30 microns.

6. A composition according to claim 5 wherein the detergent surfactant comprises a water-soluble salt of an organic sulfuric reaction product having in its molecular structure an alkyl group containing from about 8 to about 22 carbon atoms and a sulfonic acid or sulfuric acid ester group.

7. A composition according to claim 5 wherein the detergent surfactant is selected from the group consisting of sodium linear $C_{10}$–$C_{13}$ alkylbenzene sulfonate; sodium $C_{10}$–$C_{18}$ alkyl sulfate; the sodium salt of a sulfated condensation product of a $C_{10}$–$C_{18}$ alcohol with from about 1 to about 3 moles of ethylene oxide; the condensation product of a $C_{10}$–$C_{18}$ fatty alcohol with from about 4 to about 10 moles of ethylene oxide; the water-soluble sodium and potassium salts of higher fatty acids containing from about 10 to about 18 carbon atoms; and mixtures thereof.

8. A composition according to claim 7 further comprising from about 1% to about 30% by weight of a water-soluble detergency builder.

9. A composition according to claim 3 wherein the detergent surfactant is selected from the group consisting of sodium linear $C_{10}$–$C_{13}$ alkylbenzene sulfonate; sodium $C_{10}$–$C_{18}$ alkyl sulfate; the sodium salt of a sulfated condensation product of a $C_{10}$–$C_{18}$ alcohol with from about 1 to about 3 moles of ethylene oxide; the condensation product of a $C_{10}$–$C_{18}$ fatty alcohol with from about 4 to about 10 moles of ethylene oxide; the water-soluble sodium and potassium salts of higher fatty acids containing from about 10 to about 18 carbon atoms; and mixtures thereof.

10. A composition according to claim 9 further comprising from about 5% to about 30% by weight of a water-soluble detergency builder.

11. A composition according to claim 10 wherein the silicone suds controlling agent has an average droplet diameter of from about 5 to about 30 microns.

12. A composition according to claim 3 wherein the water content is from about 15% to about 70% and the ionic strength is greater than about 0.9 moles/100 gms of product.

13. A composition according to claim 12 wherein the water content is from about 20% to about 40% and the ionic strength is greater than about 0.95 moles/100 gms of product.

* * * * *